United States Patent [19]

Lillethorup

[11] 4,068,440

[45] Jan. 17, 1978

[54] FRAMING JOINT CONSTRUCTION AND CLIP THEREFOR

[75] Inventor: Ben W. Lillethorup, Henrico County, Va.

[73] Assignee: Reynolds Metals Company, Richmond, Va.

[21] Appl. No.: 689,111

[22] Filed: May 24, 1976

[51] Int. Cl.[2] ..... E04H 12/00; E04D 1/34

[52] U.S. Cl. ..... 52/301; 52/547; 403/167; 403/376

[58] Field of Search ..... 52/301, 712, 758 R, 52/729, 730, 716, 717, 713, 238, 241, 349, 760, 715, 758 C, 489, 509, 511, 753 D; 287/189.35, 189.36 R; 24/73, 230.5, 230.5 R, 230.5 ST, 237; 403/167, 168, 376, 380, 382

[56] References Cited

U.S. PATENT DOCUMENTS

| | | | |
|---|---|---|---|
| 3,276,179 | 10/1966 | Rallis | 52/712 X |
| 3,302,357 | 2/1967 | Scott | 52/547 X |
| 3,465,487 | 9/1969 | Fatosme et al. | 52/301 X |
| 3,862,535 | 1/1975 | Byssing | 52/712 X |
| 3,877,193 | 4/1975 | Hall | 52/729 X |
| 3,881,293 | 5/1975 | Conville | 52/712 |

FOREIGN PATENT DOCUMENTS

| | | | |
|---|---|---|---|
| 323,781 | 5/1970 | Sweden | 52/285 |

*Primary Examiner*—Price C. Faw, Jr.
*Assistant Examiner*—Robert C. Farber
*Attorney, Agent, or Firm*—Glenn, Lyne, Gibbs & Clark

[57] ABSTRACT

A framing joint construction and clip therefor which is readily assembled as a structural system. A base frame member is outfitted with a plurality of clips along a horizontally extending support surface vertically spaced from a foundation-engaging surface of the base member. A vertically extending stud member is inserted into a U-shaped section of the clips and automatically locked in place. A cover member, which preferably is identical to the base member but mounted in inverted position, is mounted atop the stud member with the use of identical clips.

12 Claims, 3 Drawing Figures

FRAMING JOINT CONSTRUCTION AND CLIP THEREFOR

This invention relates to a framing joint construction and clip therefor and, more particularly, to the use of clips in a framing joint construction which obviates the need for nuts, bolts, screws or tabs.

Heretofore it has been the practice to assembly framing joint constructions such as is disclosed herein by drilling or punching holes through the structural members and assembling them together in rather tedious fashion with the use of conventional fastener assemblies. The time required to complete the fabrication and assembly of the system has been so long that this necessarily added to the original expenses, making the sale of an entire system or installation more difficult.

In accordance with the present invention, conventional fastener assemblies are eliminated and the parts of the framing system can be easily and quickly outfitted utilizing the clip of the present invention and then assembled together simply by effecting relative sliding movement of the parts.

The clip itself has a U-shaped section which provides a channel adapted to receive a vertically extending stud member. The U-shaped sections of the clip are formed from a pair of leg members joined together at their base with one of the legs of the U-shaped section having an extension which is reversely bent in a first direction and then reversely bent again so as to extend toward the base of the U-shaped section and is adapted to cooperate with the base of the clip to receive a horizontally extending support surface for the vertically extending stud member.

The inherent advantages and improvements of the present invention will become more readily apparent upon consideration of the following detailed description thereof and by reference to the drawings in which.

Figure 1:
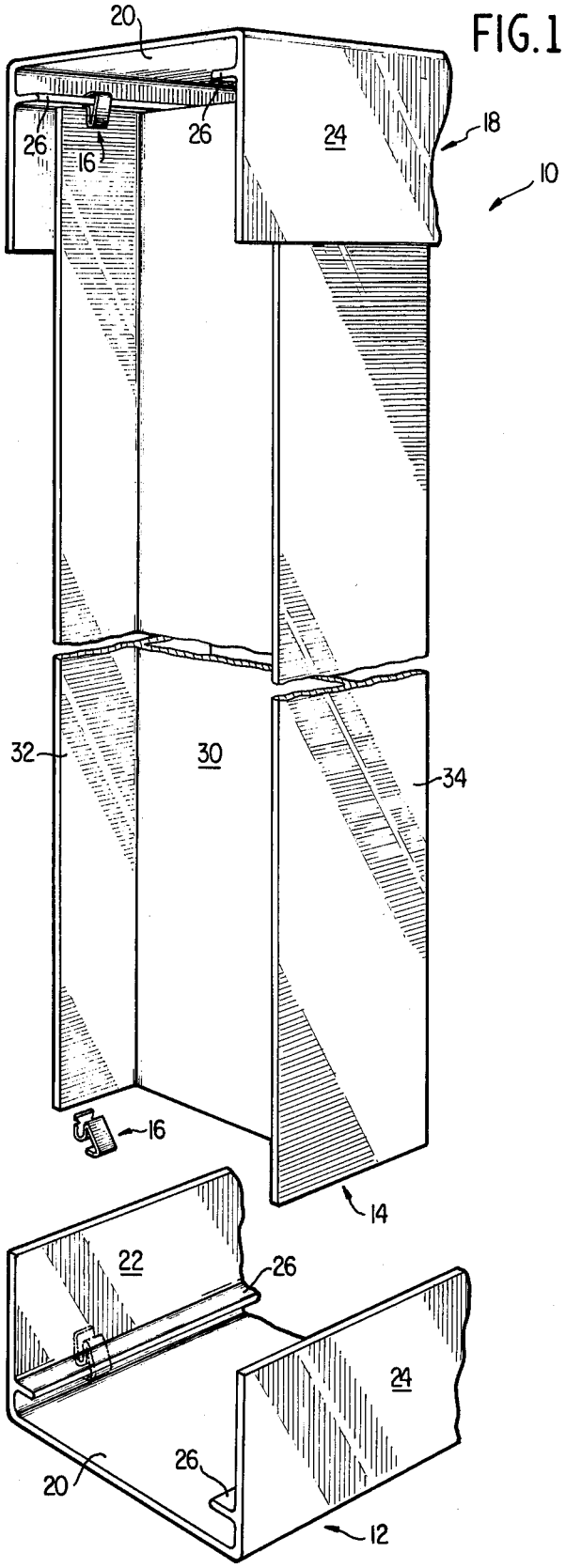
FIG. 1 is a partially exploded fragmentary view illustrating the assembly of a framing joint construction in combination with the clip of this invention.

Referring now more particularly to FIG. 1 of the drawings, there is illustrated a framing joint construction assembly, indicated generally at 10, the principal components of which include a base member, indicated generally at 12, a vertically extending stud member, indicated generally at 14, a clip 16, and a top or cover member indicated generally at 18. In a preferred form of the invention, the top or cover member 18 is identical to base member 12 but mounted in an inverted position.

Base member 12 and top or cover member 18 are provided with a foundation-engaging surface 20. The term "foundation" is used in this specification to identify a floor, ground, or other support member but includes non-support members such as a ceiling. Base member 12 and cover member 18 also have opposed wall members 22 and 24 with each wall member carrying a ledge 26 defining a horizontally extending support surface. It should be observed that while the horizontally extending surface 26 may be discontinuous such as in the form of a lug or other projection, it is preferred to make the base member 12 and top or cover member 18 from an aluminum extrusion whereby the ledge 26 constitutes a continuous horizontally extending support surface.

The vertically extending stud member 14 is shown to comprise an I-beam member made from either steel or aluminum having a central web 30 and end flanges 32 and 34. If desired, the stud member 14 could take other shapes such as a channel-shaped member.

Figure 2:
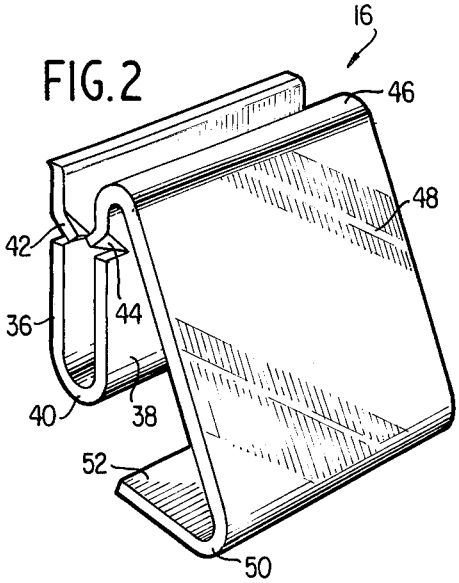
FIG. 2 is an enlarged perspective view of one of the clips shown in FIG. 1.

Referring now to FIG. 2 of the drawings, the clip 16 is shown to comprise upstanding opposed legs 36 and 38 joined at one end at 40 so as to provide a vertically extending upwardly open channel between the legs 36 and 36 and 38. As illustrated, legs 36 and 38 may have inwardly struck tongues 42 and 44 so as to automatically lock the flanges of the stud member therein as illustrated in phantom at 32 in FIG. 3.

Figure 3:
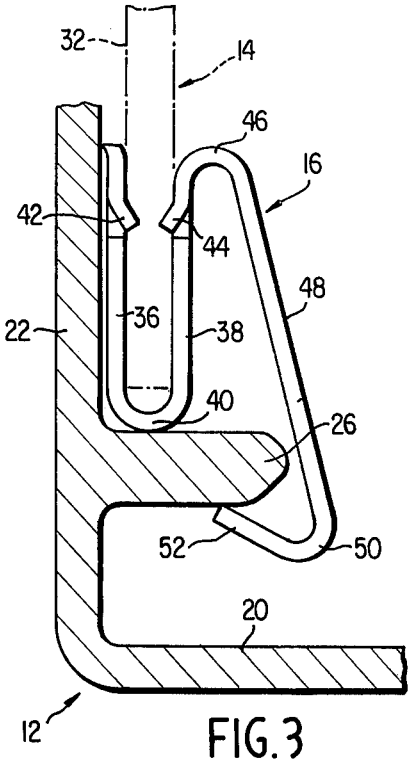
FIG. 3 is a fragmentary elevational view drawn to an enlarged scale and taken in vertical cross section illustrating the assembled position.

As is illustrated in FIGS. 2 and 3, one of the legs of the clip member 16, namely, leg 38, is provided with an extension which is reversely bent at 46 providing a downwardly extending portion 48 which is then again reversely bent at 50 to provide a terminal extension 52 so as to extend toward the base 40 of the U-shaped section of the spring clip 16. Preferably, the extension is longer than the legs which form the U-shaped section of the spring clip so that the terminal portion 52 is engageable with an under surface of the horizontally extending support surface 26 while the base 40 of the U-shaped section is engageable with the upper surface of the horizontally extending support surface 26.

The parts are assembled together by effecting relative sliding movement between the parts. Spring clips 16 are located substantially randomly along the horizontally extending support surface 26 in the position illustrated in FIG. 3 and the vertically extending stud member is inserted within the U-shaped opening provided by legs 36 and 38 and base 40. Inwardly struck tongues 42 and 44 in clips 16 automatically lock the stud member in place. In similar fashion, the clips are attached to the horizontally extending support surface 26 of the cover member 18 and relative movement between the cover member 18 and stud 14 effects a union of the cover member and stud member.

The clips 16 are preferably made from spring steel, the base member 12 and the cover member 18 and the stud member 14 are preferably made from extruded aluminum and are preferably coated with a primer and two coats of baked aluminum paint to avoid electrolytic action. While the clips could be made from stainless steel, this is considered to be too expensive at the present time.

In a typical installation, the channel-shaped base member 12 is secured to a foundation by means of a standard pneumatic nailer or stud driver. With this system of assembly, it is no longer necessary to drill the respective parts in order to obtain their assembly and the stud members can be snapped into position at the job site or wherever desired.

While a presently preferred embodiment of the invention has been illustrated and described, it will be recognized that the invention may be otherwise variously embodied and practiced within the scope of the claims which follow.

What is claimed is:

1. A framing joint construction intended to be readily assembled comprising a. a base member having a foundation-engaging surface and at least one vertically extending wall-defining member extending upwardly therefrom, b. means defining a horizontal support surface vertically spaced from said foundation-engaging surface, c. clip means attached to said means defining a horizontal support surface, 1. said clip means including a U-shaped section providing a vertically extending upwardly open channel, d. a vertically extending stud member received in said U-shaped section of said clip means, e. and a cover member attached to said vertically extending stud member at the top thereof.

2. A framing joint construction as defined in claim 1, wherein said cover member is identical to said base member and mounted in inverted position.

3. A framing joint construction as defined in claim 1, wherein said horizontal support surface is continuous and said base member is formed as an extruded member.

4. A framing joint construction as defined in claim 3, wherein said base and cover members are aluminum extrusions.

5. A framing joint construction as defined in claim 1 wherein said base member is a channel-shaped member and said means defining a horizontal support surface vertically spaced from said foundation-engaging surface constitutes a pair of opposed ledges extending inwardly from the inner walls of said channel-shaped member.

6. A framing joint construction as defined in claim 5 wherein said vertically extending stud member constitutes an I-beam member having flanges received in U-shaped sections of said clip means.

7. A framing joint construction as defined in claim 5 wherein said cover member is also a channel-shaped member and mounted in inverted position.

8. A framing joint construction as defined in claim 5 wherein said horizontal support surface is continuous and said base member is formed as an aluminum extrusion.

9. A clip for joining members together whose surfaces are at right angles to each other and extend in planes normal to each other which comprises a. a U-shaped section providing a channel adapted to receive a vertically extending stud member, b. said U-shaped section being formed from a pair of leg members joined together by a base member, c. one of the legs of the U-shaped section having a reversely bent leg portion the terminal portion of which is formed to extend toward and beneath the base of the U-shaped section and which is adapted to cooperate with said base to receive a horizontally extending support surface for the vertically extending stud member.

10. A clip for joining members together as defined in claim 9 wherein said clip is formed from spring steel.

11. A clip for joining members together as defined in claim 9 wherein the legs of said U-shaped section are provided with tongues which extend inwardly toward the channel provided by said U-shaped section to lock the vertically extending stud member in place.

12. A clip for joining members together as defined in claim 9 wherein the reversely bent leg portion is longer than the legs forming the U-shaped section so that the terminal portion thereof is engageable with an under surface of the horizontally extending support surface while the base of the U-shaped section is engageable with an upper surface of the horizontally extending support surface.

* * * * *